US012753548B2

(12) United States Patent
Lee et al.

(10) Patent No.: US 12,753,548 B2
(45) Date of Patent: Oct. 6, 2026

(54) SEAT MOLDED ARTICLE AND PREPARING METHOD THEREOF

(71) Applicants: HYUNDAI MOTOR COMPANY, Seoul (KR); KIA CORPORATION, Seoul (KR); TKG ECO MATERIAL Co., Ltd., Busan (KR); Hyundai Transys Inc., Seosan-si (KR)

(72) Inventors: Myoung Ryoul Lee, Seoul (KR); Byungguk Lim, Seoul (KR); Jun Ho Song, Hwaseong-si (KR); Hye Rin Choi, Hwaseong-si (KR); Gu Hwan Kim, Busan (KR); Tyuckkyu Hwang, Busan (KR)

(73) Assignees: HYUNDAI MOTOR COMPANY, Seoul (KR); KIA CORPORATION, Seoul (KR); Hyundai Transys Inc., Seosan-si (KR)

( * ) Notice: Subject to any disclaimer, the term of this patent is extended or adjusted under 35 U.S.C. 154(b) by 391 days.

(21) Appl. No.: 18/214,744

(22) Filed: Jun. 27, 2023

(65) Prior Publication Data

US 2024/0141585 A1 May 2, 2024

(30) Foreign Application Priority Data

Nov. 2, 2022 (KR) ..... 10-2022-0144646

(51) Int. Cl.

| | |
|---|---|
| ***D06N 3/00*** | (2006.01) |
| ***D03D 1/00*** | (2006.01) |
| ***D03D 15/283*** | (2021.01) |
| ***D03D 15/513*** | (2021.01) |
| ***D03D 15/56*** | (2021.01) |
| ***D06C 7/00*** | (2006.01) |
| ***D06N 3/14*** | (2006.01) |

(52) U.S. Cl.

CPC ..... *D06N 3/0045* (2013.01); *D03D 1/00* (2013.01); *D03D 15/283* (2021.01); *D03D 15/513* (2021.01); *D03D 15/56* (2021.01); *D06C 7/00* (2013.01); *D06N 3/0006* (2013.01); *D06N 3/146* (2013.01); *D06N 3/147* (2013.01); *D06N 2201/0209* (2013.01); *D06N 2209/067* (2013.01); *D10B 2331/04* (2013.01); *D10B 2401/061* (2013.01); *D10B 2505/08* (2013.01)

(58) Field of Classification Search

None

See application file for complete search history.

(56) References Cited

U.S. PATENT DOCUMENTS

| | | | | |
|---|---|---|---|---|
| 5,853,878 | A | 12/1998 | Ishiwata et al. | |
| 9,315,926 | B2 | 4/2016 | Date et al. | |
| 2011/0025109 | A1 | 2/2011 | Ryczek et al. | |
| 2015/0111451 | A1* | 4/2015 | Date | D03D 15/47 442/184 |
| 2020/0362483 | A1 | 11/2020 | Luh | |

FOREIGN PATENT DOCUMENTS

| | | | | | |
|---|---|---|---|---|---|
| EP | 2279903 | A2 | | 2/2011 | |
| JP | H0523232 | A | | 2/1993 | |
| JP | 2005066219 | A | | 3/2005 | |
| JP | 2017056126 | A | | 3/2017 | |
| KR | 100306316 | B1 | | 11/2001 | |
| KR | 100594882 | B1 | | 6/2006 | |
| KR | 20090072341 | A | | 7/2009 | |
| KR | 101556073 | B1 | | 9/2015 | |
| KR | 102469094 | B1 | * | 11/2022 | B32B 5/18 |
| KR | 10-2023-0067980 | | * | 5/2023 | C08G 18/48 |

OTHER PUBLICATIONS https://patents.google.com/patent/KR20230067980A/en?oq=18214744 (Year: 2023).* https://patents.google.com/patent/KR102469094B1/en?oq=KR102469094 (Year: 2022).*

* cited by examiner

*Primary Examiner* — Arti Singh-Pandey

(74) *Attorney, Agent, or Firm* — Lempia Summerfield Katz LLC

(57) ABSTRACT

A seat molded article and a method of preparing a seat molded article are disclosed. The seat molded article includes: an upper pad formed of polyurethane foam having a thickness in a range of 25 to 50 mm; and an elastic fabric disposed under the upper pad, wherein, in the elastic fabric, a difference in tensile elongation between warp and weft directions is 5.0% or less, and a tensile elongation measured under a load of 20 kgf is in a range of 20 to 40% in the warp and weft directions.

16 Claims, No Drawings

SEAT MOLDED ARTICLE AND PREPARING METHOD THEREOF

CROSS-REFERENCE TO RELATED APPLICATION(S)

This application claims the benefit of and priority to Korean Patent Application No. 10-2022-0144646, filed on Nov. 2, 2022, in the Korean Intellectual Property Office, the disclosure of which is incorporated herein by reference.

TECHNICAL FIELD

The present disclosure relates to a seat molded article including an upper pad formed of polyurethane foam and an elastic fabric disposed under the upper pad and a method of preparing the same.

BACKGROUND

The statements in this section merely provide background information related to the present disclosure and may not constitute prior art.

In recent years, trends related to designs of vehicles are changing to lower overall height of vehicles and consumer needs for wide indoor space of vehicles is increasing for leisure activities inside the vehicles. In order to meet these consumer expectations, the industry's needs to reduce thickness of seats that occupy the largest volume among interior parts of vehicles are increasing.

Meanwhile, Korean Patent No. 10-1556073 discloses a method of using a stretch fabric including an elastic yarn in a seat cushion instead of urethane foam. However, cushion performance is not considered in the disclosed method, and thus there are limits to mass-produce the stretch fabric for seats of vehicles.

SUMMARY

An aspect of the disclosure is to provide a seat molded article having a reduced volume (thickness) of seat cushions with comfort performance maintained at a level of products applied conventional seat cushions and a method of preparing the same. Particularly, a seat molded article and methods of preparing such articles are provided that have excellent comfort performance with reduced thickness of cushions compared to conventional seats by using an elastic fabric instead of suspension springs, commonly used in conventional seat cushions, and using high-hardness urethane foam at a certain level or higher.

Additional aspects of the disclosure are set forth in part in the description which follows and, in part, are obvious from the description or may be learned by practice of the disclosure.

In accordance with an aspect of the present disclosure, a seat molded article includes an upper pad formed of polyurethane foam having a thickness in a range of 25 to 50 mm; and an elastic fabric disposed under the upper pad. In the elastic fabric, a difference in tensile elongation between warp and weft directions is 5.0% or less, and a tensile elongation measured under a load of 20 kilogram-force (kgf) is in a range of 20 to 40% in the warp and weft directions.

The seat molded article may have an amount of sagging, measured under a load of 55 kgf, in a range of 25 to 50 mm. The amount of sagging of the seat molded article measured under the load of 55 kgf may account for 40 to 70% of the amount of sagging measured under a load of 100 kgf.

The elastic fabric may have a tensile elongation, measured under a load of 40 kgf, in a range of 40 to 90% in the warp and weft directions. The elastic fabric may have a tensile elongation, measured under a load of 34.7 kgf, in a range of 20 to 50% in the warp and weft directions. The elastic fabric may have a tensile elongation, measured under a load of 51 kgf, in a range of 50 to 90% in the warp and weft directions.

The elastic fabric may be formed of elastic monofilaments including a thermoplastic polyester elastomer resin as grey yarn.

A thickness of the grey yarn may be in a range of 0.14 to 0.5 mm.

The thermoplastic polyester elastomer resin may include a hard segment and a soft segment. An amount of the soft segment is in a range of 10 to 50 wt. % based on a total weight of the thermoplastic polyester elastomer resin.

The grey yarn may further include a phosphorus-based flame retardant.

The polyurethane foam may be a polymer of 100 parts by weight of a polyol mixture A and 10 to 50 parts by weight of an isocyanate compound B.

The polyol mixture A may include (a1) a polyether polyol having 2 to 6 hydroxyl groups. The isocyanate compound B may include: (b1) a polymer of an isocyanate mixture of monomeric methylene diphenyl diisocyanate (M-MDI) and polymeric methylene diphenyl diisocyanate (P-MDI) with a polyether polyol; or (b2) toluene diisocyanate (TDI).

In accordance with an aspect of the present disclosure to solve the above-described problems, a method of preparing a seat molded article includes: preparing a polyurethane foam having a thickness in a range of 25 to 50 mm; preparing an elastic fabric; and disposing the elastic fabric under the polyurethane foam. The preparing of the elastic fabric includes: weaving the elastic fabric from grey yarn formed of a thermoplastic polyester elastomer resin in which a hard segment and a soft segment are polymerized; scouring the elastic fabric at a temperature in a range of 90 to 95° C.; and heat-treating the scoured elastic fabric at a temperature in a range of 150 to 165° C.

The soft segment may be included in an amount in a range of 10 to 50 wt. % based on a total weight of the thermoplastic polyester elastomer resin.

A thickness of the grey yarn may be in a range of 0.14 to 0.5 mm.

The scouring of the elastic fabric at a temperature in a range of 90 to 95° C. may be performed at a scouring rate in a range of 20 to 25 m/min.

A natural shrinkage rate of the scoured elastic fabric may be 30% or less.

The preparing of the polyurethane foam may include: preparing a polyol mixture A by mixing a polyether polyol having 2 to 6 hydroxyl groups, a foam stabilizer, and a catalyst; and performing condensation polymerization in a range of 10 to 50 parts by weight of an isocyanate compound B with 100 parts by weight of the polyol mixture A and foaming the polymer.

The isocyanate compound B may include (b1) a polymer of an isocyanate mixture including a monomeric methylene diphenyl diisocyanate (M-MDI) and a polymeric methylene diphenyl diisocyanate (P-MDI) with a polyether polyol; or (b2) a toluene diisocyanate (TDI).

DETAILED DESCRIPTION

Reference is now made in detail to the embodiments of the disclosure. However, the disclosure may be embodied in different ways and is not limited to embodiments described herein.

Throughout the specification, when an element is referred to as being "connected to" another element, the element may be "directly connected to" the other element, or the element may also be "electrically connected to" the other element with an intervening element therebetween.

Throughout the specification, when one element is referred to as being "on" another element, the element can be directly on the other element, or intervening elements may also be present therebetween.

Throughout the specification, when an element is referred to as "including" or "comprising" another element, unless otherwise stated, the element may further include or comprise yet another element rather than preclude the yet other element.

The terms "about", "substantially", etc. used throughout the specification means that when a natural manufacturing and a substance allowable error are suggested, such an allowable error corresponds the value or is similar to the value, and such values are intended for the sake of clear understanding of the present disclosure or to prevent an unconscious infringer from illegally using the disclosure of the present disclosure.

Throughout the specification, the term "operation of" or "operation" does not mean "operation for".

Throughout the specification, the term "any combination(s) thereof" recited in the expression of the Markush type claim may mean that at least one or more mixing or combination may be selected from a group consisting of multiple components recited in the expression of the Markush type, more specifically, it may mean that one or more components selected from a group consisting of components may be included.

Throughout the specification, the term "A and/or B" means "A or B, or A and B." When a component, device, element, or the like of the present disclosure is described as having a purpose or performing an operation, function, or the like, the component, device, or element should be considered herein as being "configured to" meet that purpose or to perform that operation or function.

Hereinafter, each of the components of a seat molded article and a method of preparing the same according to the present disclosure are described. However, embodiments of the present disclosure may not be limited thereto.

Seat Molded Article

An aspect of the present disclosure provides a seat molded article including an upper pad formed of polyurethane foam used in a component to manufacture a seat having a cushion thickness of 50 mm or less and an elastic fabric disposed under the upper pad.

In the seat molded article according to the present disclosure, polyurethane foam is disposed at an upper position and the elastic fabric is disposed at a lower position. The elastic fabric located at the lower position compensates for insufficient comfort performance of the polyurethane foam with a smaller thickness than conventional products. On the contrary, in the case where the elastic fabric is located at the upper position and the polyurethane foam is located at the lower position, comfortable cushion feelings affected by the polyurethane foam under a low load is lost.

In addition, the seat molded article according to the present disclosure is prepared by replacing suspension springs conventionally used in seat cushions of vehicles with an elastic fabric. A seat component manufactured according to the present disclosure may provide a user sitting on a seat with comfort performance without feelings of irritation in the seat while having a reduced volume of the seat component by adjusting the thickness of the cushion in a range of 25 to 50 mm. Accordingly, the thickness of the seat may be reduced while having emotional quality maintained compared to conventional products, resulting in high commercial values and productivity.

In an embodiment, an amount of sagging of the seat molded article measured under a load of 55 kgf may be in a range of 25 to 50 mm. In the seat molded article, the amount of sagging measured under the load of 55 kgf may account for 40 to 70% of the amount of sagging measured under a load of 100 kgf. When these conditions are satisfied, comfort performance required when a user is seated may be satisfied.

In addition, the present disclosure may provide interior seat components of vehicles manufactured by using the seat molded article.

Upper Pad

In an embodiment of the present disclosure, an upper pad formed of polyurethane foam having a thickness in a range of 25 to 50 mm is used to reduce the thickness of the seat molded article. While a thickness of the polyurethane foam is about 70 to 90 mm in conventional seat cushions, a volume of a seat component may be reduced by using the polyurethane foam having a thickness in a range of 25 to 50 mm in the present disclosure. Also, reduced comfort performance, decreased feelings of being supported, and increased feelings of irritation caused by the reduced thickness of the polyurethane foam may be compensated for by the elastic fabric described below.

In an embodiment, the polyurethane foam may be prepared by performing condensation polymerization in a range of 10 to 50 parts by weight of an isocyanate compound B and 100 parts by weight of a polyol mixture A and foaming the polymer.

The polyol mixture A may include (a1) a polyether polyol having 2 to 6 hydroxyl groups. The polyether polyol may include 2 to 6 hydroxyl groups on average and have a hydroxyl (OH) value in a range of 10 to 60 mg KOH/g, a content of ethylene oxide (EO) greater than 0 wt. % and equal to or less than 20 wt. %, and a structure in which the ethylene oxide is addition polymerized as a terminal or block, without being limited thereto.

In addition, the polyol mixture A may further include at least one additive. The additive may include a foam stabilizer, a crosslinking agent, a blowing agent, a catalyst, or a combination thereof.

While cells are formed in the polyurethane foam, the foam stabilizer prevents the formed cells from being combined or destroyed. Additionally, the foam stabilizer adjusts the cells to be formed in a uniform shape and size. In certain examples, a silicone foam stabilizer may be used. The silicone foam stabilizer may include a polysiloxane or derivative thereof, (e.g., a polyalkyleneoxidemethylsilocane copolymer). Conventionally, the foam stabilizer is used in an amount in a range of 0 to 2 parts by weight based on 100 parts by weight of the polyol. However, as the amount of the foam stabilizer increases, a problem of shrinkage of foam may occur, and thus the foam stabilizer is used in an amount in a range of 0 to 1 part by weight in the present disclosure.

The crosslinking agent may have 2 to 3 hydroxyl groups and a hydroxyl value in a range of 200 to 2000 mg KOH/g and may include ethylene glycol, 1,4-butanediol, diethyleneglycol, triethyleneglycol, dipropyleneglycol, monoethanolamine, diethanolamine, triethanolamine, glycerin, or any combination of two or more thereof. Although the crosslinking agent may be used in an amount in a range of 0 to 1 part by weight based on 100 parts by weight of a resin premix, the amount of the crosslinking agent is controlled in a range of 1 to 3 parts by weight to improve stability of cells at a high index according to the present disclosure.

Water is used as the blowing agent in an amount in a range of 2 to 4 parts by weight based on 100 parts by weight of the resin premix.

The catalyst serves to promote reaction between the polyol and the isocyanate compound. The catalyst may include an amine catalyst such as triethylenediamine, triethyl amine, diethanolamine, triethanolamine, N-methyl morpholine, or N-ethyl morpholine. In other examples, the catalyst may include an organic tin catalyst such as stannous octoate or dibutyltin dilaurate (DBTDL). The catalyst may be used in an amount in a range of 0.01 to 10 parts by weight or in a range of 0.5 to 5 parts by weight, based on 100 parts by weight of the polyol. However, in the present disclosure, as the catalyst, a mixture of a foaming catalyst and a curing catalyst is used in an amount in a range of 0 to 1 part by weight to obtain foaming and curing properties.

The isocyanate compound B may include: (b1) a polymer of an isocyanate mixture including a monomeric methylene diphenyl diisocyanate (M-MDI) and a polymeric methylene diphenyl diisocyanate (P-MDI) with a polyether polyol; or (b2) a toluene diisocyanate (TDI).

For example, the M-MDI contained in the isocyanate mixture may be 4,4'-methylenediphenyldiisocyanate (4,4'-MDI) monomer and an M-MDI having a weight average molecular weight in a range of 220 to 280 g/mol may be used. The amount of the M-MDI contained in the (b1) polymer of the isocyanate compound may be in the range of 50 to 70 wt. %. In addition, the polyether polyol may include 2 to 6 hydroxyl groups on average and have a hydroxyl (OH) value in a range of 10 to 60 mg KOH/g, a content of ethylene oxide (EO) greater than 0 wt. % and equal to or less than 20 wt. %, and a structure in which the ethylene oxide is addition polymerized as a terminal or block, without being limited thereto.

In an embodiment, the polyurethane foam may have a hardness in a range of 4.8 to 7.8 kPa. When the above-described range is satisfied, comfort properties at a level suitable for use as seat cushions of vehicles may be provided.

Polyurethane foam, as a material commonly used in seat cushions, plays the biggest role in realizing comfort performance in conventional seats. In certain examples, a degree of contribution of polyurethane foam to performance of seat cushions may be in a range of 40 to 65% in a seat component, and seat cushions have been manufactured by adjusting hardness and thickness of polyurethane foam in order to provide optimal comfort performance in accordance with designs and shapes of various vehicle models in the automotive industry.

Comfort performance provided by the polyurethane foam is considerably affected by the thickness of a seat cushion in the seat component and a load applied to the cushion. When the load applied to the polyurethane foam is higher than a certain level, the polyurethane foam reaches a compression limit state in which size of pores in the polyurethane foam converges into 0, so as to lose elastic properties, resulting in significant deterioration in comfort performance. In addition, polyurethane foam conventionally used seat cushions has a thickness in a range of 70 to 90 mm. In the case where the thickness of polyurethane foam decreases to about 60% or less (about 50 mm or less) compared to that used in conventional seat cushions, the polyurethane foam reaches the limit compression more quickly than that of thick cushions having a thickness in a range of 70 to 90 mm by the same load and pressure applied thereto causing loss of the feelings of being supported and occurrence of the feelings of touching the floor. However, when the content of polyurethane foam and/or raw materials thereof is increased to prevent the loss of the feelings of being supported and to remove the feelings of touching the floor, hardness of the polyurethane foam excessively increases resulting in adverse effects on comfort performance.

Therefore, in the present disclosure, attempts have been made to prevent the loss of the feelings of being supported and the occurrence of in the feelings of touching the floor by reducing the degree of contribution of polyurethane foam, used as the upper pad, to comfort performance and by using the elastic fabric to replace conventional metal suspension springs for optimization of comfort performance of a seat component having a reduced thickness of a seat cushion.

Elastic Fabric

The elastic fabric is used to improve comfort performance by replacing suspension springs of conventional seat cushions and disposed under the upper pad.

According to an embodiment, the elastic fabric is woven from wefts and warps of elastic monofilaments including a thermoplastic polyester elastomer resin as grey yarn. In addition, a thickness of the grey yarn may be in a range of 0.14 to 0.5 mm.

The thermoplastic polyester elastomer resin may include a hard segment that is a crystalline part and a soft segment that is a non-crystalline part.

The hard segment may be formed of an aromatic polyester, most of which is polybutylene terephthalate. For example, the hard segment may be formed of a mixture of 2,6-naphthanlene dicarboxylic acid and derivatives thereof, terephthalic acid, and 1,4-butandiol.

The soft segment may be formed of aliphatic polyether, most of which is polytetramethylene glycol. The amount of the soft segment may be in the range of 10 to 50 wt. % based on a total weight of the thermoplastic polyester elastomer resin. When the amount of the soft segment is less than 10 wt. %, elastic properties thereof are lost. When the amount of the soft segment is greater than 50 wt. %, a solidification rate decreases causing difficulties in manufacture in the form of elastic fabric and resulting in deterioration of physical properties.

In the elastic fabric, a difference in tensile elongation between warp and weft directions may be 5.0% or less. Specifically, the difference in tensile elongation between the warp and weft directions may be measured under a constant load in a range of 20 to 75 kgf. For example, a difference in tensile elongation between the warp and weft directions measured under a load of 20 kgf may be 5.0% or less. A difference in tensile elongation between the warp and weft directions measured under a load of 34.7 kgf may be 5.0% or less. A difference in tensile elongation between the warp and weft directions measured under a load of 40 kgf may be 5.0% or less. A difference in tensile elongation between the warp and weft directions measured under a load of 51 kgf may be 5.0% or less. A difference in tensile elongation between the warp and weft directions measured under a load of 75 kgf may be 5.0% or less.

In an embodiment, a difference between a sum of strengths of the grey yarn used within 1 inch (2.54 cm) of the warp (lengthwise) direction of the woven fabric and a sum of strength of the grey yarn used within 1 inch (2.54 cm) of the weft (transverse) direction may be 5.0% or less. By designing the difference in the sum of strengths between the warp and weft directions to be 5.0% or less, the elastic fabric may satisfy the conditions of 5.0% or less of the difference in tensile elongation between the warp and weft directions under a constant load. When the difference in tensile elongation between the warp and weft directions exceeds 5.0%, a load applied to the seat molded article is concentrated in one direction in the case where the seat molded article supports the load resulting in deterioration of strength of the elastic fabric due to repeated loads applied thereto.

In an embodiment, in the elastic fabric, a tensile elongation measured under a load of 20 kgf may be in a range of 20 to 40% in the warp and weft directions, and a tensile elongation measured under a load of 34.7 kgf may be in a range of 20 to 50% in the warp and weft directions. In addition, in the elastic fabric, a tensile elongation measured under a load of 40 kgf may be in a range of 40 to 90% in the warp and weft directions, and a tensile elongation measured under a load of 51 kgf may be in a range of 50 to 90% in the warp and weft directions. In addition, a tensile elongation measured under a load of 75 kgf may be 100% or more in the warp and weft directions.

When the tensile elongation of the elastic fabric under the load of 20 kgf is less than 20%, the effect thereof as an alternative to suspension springs is low. In addition, even when the tensile elongation under the load of 20 kgf is 20% or more, a damage occurs in the elastic fabric before reaching a normal level of cushion performance in the case where the tensile elongation under the load of 40 kgf is less than 40%. On the contrary, when the tensile elongation under the load of 20 kgf is greater than 50%, a vibration of the cushion in a frequency range of 5 to 8 Hz is 3 or more due to excessive tensile elongation, and thus a problem of increasing vibration transfer in vehicles occurs.

In an embodiment of the present disclosure, the elastic fabric satisfying the tensile elongation requirements under a constant load is designed to meet physical property requirements of the present disclosure by using grey yarn including elastic monofilaments in the warp (lengthwise) and weft (transverse) directions and having a thickness in a range of 0.14 mm to 0.5 mm.

In this regard, a thermoplastic polyester elastomer (TPEE) material may be used in the elastic monofilament grey yarn, and not only elastic monofilament grey yarn in the form of single component but also sheath/core-type hot-melt elastic monofilament grey yarn in the form of heterologous components may be used. For example, in the case of using the sheath/core-type hot-melt elastic monofilament grey yarn, the TPEE resin of the sheath part melts during heat treatment at 150° C. or higher to be adhered to warps and wefts, and thus a problem of skipped stitches, one of disadvantages of woven fabrics, may be solved and it is advantageous to apply the same to seat cushion components of vehicles.

In an embodiment, the elastic fabric, as a fabric applied to seat cushions, should satisfy flame retardancy, and the grey yarn may include a phosphorus-based flame retardant to obtain satisfactory flame retardancy. The phosphorus-based flame retardant may be contained in an amount of 20 wt. % or more based on the total weight of a composition for preparing the grey yarn. When the content of the phosphorus-based flame retardant is less than 20 wt. %, the elastic fabric may not have self-extinguishability.

Method of Preparing Seat Molded Article

The present disclosure provides a method of preparing a seat molded article including: preparing a polyurethane foam having a thickness in a range of 25 to 50 mm; preparing an elastic fabric; and disposing the elastic fabric under the polyurethane foam. All descriptions given above with reference to the seat molded article may also be applied to the method of preparing a seat molded article according to the present disclosure. Although the descriptions presented above are omitted, they may be applied in the same manner below.

Preparation of Polyurethane Foam

The polyurethane foam having a thickness in a range of 25 to 50 mm is prepared as the upper pad of the seat molded article.

In an embodiment, the operation of preparing the polyurethane foam may include: preparing a polyol mixture A by mixing a polyether polyol having 2 to 6 hydroxyl groups, a foam stabilizer, and a catalyst; and performing condensation polymerization in a range of 10 to 50 parts by weight of the isocyanate compound B with 100 parts by weight of the polyol mixture A and foaming the polymer.

In addition, the isocyanate compound B may include: (b1) a polymer of an isocyanate mixture including a monomeric methylene diphenyl diisocyanate (M-MDI) and a polymeric methylene diphenyl diisocyanate (P-MDI) with a polyether polyol; or (b2) a toluene diisocyanate (TDI).

Preparation of Elastic Fabric

The operation of preparing the elastic fabric includes weaving the elastic fabric from grey yarn formed of a thermoplastic polyester elastomer resin in which the hard segment and the soft segment are polymerized. The grey yarn may include a thermoplastic polyester elastomer (TPEE) material as the elastic monofilament grey yarn. In addition, the elastic monofilament grey yarn includes not only elastic monofilament grey yarn in the form of single component but also sheath/core-type hot-melt elastic monofilament grey yarn in the form of heterologous components may be used.

In an embodiment, a composition for preparing the elastic fabric may include 10 to 50 wt. % of the soft segment and the balance of the hard segment based on the total weight of the thermoplastic polyester elastomer resin. The soft segment may be included in an amount in a range of 10 to 50 wt. % based on the total weight of the thermoplastic polyester elastomer resin. When the amount of the soft segment is less than 10 wt. %, elastic properties are lost. When the amount of the soft segment is greater than 50 wt. %, a solidification rate decreases, making it difficult to manufacture the elastic fabric, and physical properties deteriorate.

In addition, the composition for preparing the elastic fabric may further include a phosphorus-based flame retardant in an amount of 20 wt. % based on the total weight of the composition. For example, an elastic fabric satisfying flame retardancy may be manufactured by weaving elastic monofilament flame retardant grey yarn using the composition including the phosphorus-based flame retardant. When the amount of the phosphorus-based flame retardant is less than 20 wt. %, the elastic fabric may not have self-extinguishability.

Although a thickness of the grey yarn is not particularly limited as long as a target physical property, (e.g., tensile elongation), of the present disclosure is satisfied, the grey yarn may be manufactured to have a thickness in a range of 0.14 to 0.5 mm. When the thickness range is satisfied, the elastic fabric may be designed to have an appropriate grey yarn density, and accordingly a target tensile elongation range may be achieved.

In addition, the operation of preparing the elastic fabric includes scouring the elastic fabric at a temperature in a range of 90 to 95° C. Also, the operation of scouring the elastic fabric at a temperature in a range of 90 to 95° C. may be performed at a scouring rate in a range of 20 to 25 m/min. In this regard, a natural shrinkage rate of the scoured elastic fabric may be 30% or less.

In an embodiment, the elastic fabric scoring process is carried out in a facility under the scouring conditions in which the width is not fixed in the weft direction, no tension is applied in the weft direction, and a natural shrinkage rate in the warp and weft directions after the scoring process is 30% or less. When the natural shrinkage rate exceeds 30%, the process should be performed under tensile conditions with the width widened. In this case, the tensile elongation difference of the elastic fabric between the warp/weft directions under a constant load is greater than 5.0%. As described above, the scouring conditions in which the natural shrinkage rate is 30% or less correspond to conditions of a tension-free scouring device, a scouring temperature in a range of 90 to 95° C., and a scouring rate in a range of 20 to 25 m/min.

In addition, the operation of preparing the elastic fabric includes heat-treating the scoured elastic fabric at a temperature in a range of 150 to 165° C. for processing the elastic fabric. Specifically, the processing of the elastic fabric is performed under the conditions, in which the naturally shrunken state by the scouring process is maintained (processing overfeed ratio=0.0%), at a temperature in a range of 15000 to 165° C. When the heat treatment temperature is below 150° C., thermal fixation and width reduction cannot be obtained. When the heat treatment temperature exceeds 165° C., strength of the elastic monofilament grey yarn decreases, failing to obtain desired physical properties of the elastic fabric intended at the time of design. For example, in the case of manufacturing a woven fabric by using the sheath/core-type hot-melt elastic monofilament grey yarn, the TPEE resin of the sheath part melts by heat treatment at 150° C. or higher to be adhered to the warps and wefts, thereby solving a problem of skipped stitches and being efficiently applied to seat cushion components of vehicles.

Disposing of Elastic Fabric under Polyurethane Foam

The prepared elastic fabric is disposed under the polyurethane foam to manufacture the seat molded article. By locating the polyurethane foam at an upper position and locating the elastic fabric at a lower position, the elastic fabric located at the lower position compensates for insufficient comfort performance of the polyurethane foam with a smaller thickness than conventional seat products. On the contrary, in the case where the elastic fabric is located at the upper position and the polyurethane foam is located at the lower position, comfortable cushion feelings affected by the polyurethane foam under a low load is lost.

Hereinafter, the present disclosure is described in more detail with reference to the following examples. However, the following examples are merely presented to exemplify the present disclosure, and the scope of the present disclosure is not limited thereto.

EXAMPLES

Preparation Examples 1-1 to 1-6: Preparation of Elastic Fabric 1

As shown in Table 1 below, elastic fabrics having different number of warps and wefts in 1 inch of each of the lengthwise direction (warp) and transverse direction (weft) and different sums of strengths were prepared.

In Table 1 below, weft-based strength differences (%) are calculated as shown in Equation (1-1) below, and warp-based strength differences (%) are calculated as shown in Equation (1-2).

$$\text{weft-based strength difference (\%)}=(|A-B|/A)*100 \quad \text{Equation (1-1)}$$

$$\text{warp-based strength difference (\%)}=|A-B|/B)*100 \quad \text{Equation (1-2)}$$

In Equations (1-1) and (1-2), A represents a sum of strengths (cN) in the lengthwise direction (warp), and B represents a sum of strength (cN) in the transverse direction (weft).

TABLE 1

| | Lengthwise direction (warp) | | | Transverse direction (weft) | | | Weft-based | Warp-based |
|---|---|---|---|---|---|---|---|---|
| Example | Thickness (mm) | Number | Sum of strengths (cN) | Thickness (mm) | Number | Sum of strengths (cN) | strength difference (%) | strength difference (%) |
| Preparation Example 1-1 | 0.14 | 96 | 43,200 | 0.14<br>0.4 | 45<br>31 | 111,700 | 158.6 | 61.3 |
| Preparation Example 1-2 | 0.14 | 96 | 43,200 | 0.14<br>0.4 | 50<br>26 | 99,200 | 129.6 | 56.5 |
| Preparation Example 1-3 | 0.14 | 96 | 43,200 | 0.14<br>0.2 | 61<br>15 | 40,200 | 6.9 | 7.5 |
| Preparation Example 1-4 | 0.4 | 38 | 114,273 | 0.14<br>0.2 | 30<br>46 | 149,200 | 30.6 | 23.4 |
| Preparation Example 1-5 | 0.4 | 51 | 150,450 | 0.4 | 49 | 144,550 | 3.9 | 4.1 |
| Preparation Example 1-6 | 0.4 | 62 | 182,900 | 0.4 | 58 | 171,100 | 6.5 | 6.9 |

Tensile elongation of samples prepared in Preparation Examples 1-1 to 1-6 was measured under different loads in the warp and weft directions, and the results are shown in Table 2 below.

Specifically, tensile elongation of the elastic fabric samples having a width of 50 mm and a length of 250 mm was measured under a constant load by using a tensile tester for fibers according to the MS 300-32 test method, and then displacement (%) of the elastic fabric under the constant load (respectively, under the loads of 34.7 kgf, 51 kgf, and 75 kgf) was measured.

In addition, as the difference in tensile elongation between the warp and weft directions, a difference in tensile elongation between the warp and weft directions measured under the same load was expressed as an absolute value.

TABLE 2

| Example | | Load (kgf) | Lengthwise direction (warp) | Transverse direction (weft) | Warp/Weft difference |
|---|---|---|---|---|---|
| Preparation Example 1-1 | Tensile elongation under different loads (%) | 34.7 (340N) | 54.1 | 36.3 | 17.8 |
| | | 51 (500N) | 68.7 | 54.3 | 14.4 |
| | | 75 (735N) | 110.8 | 82.5 | 28.3 |
| | Tensile elongation at break (%) | | 135.8 | 135.1 | — |
| | Strength at break (N) | | 800.7 | 941.3 | — |
| Preparation Example 1-2 | Tensile elongation under different loads (%) | 34.7 (340N) | 52.4 | 42.3 | 10.1 |
| | | 51 (500N) | 67.0 | 59.5 | 7.5 |
| | | 75 (735N) | 110.9 | 93.6 | 17.3 |
| | Tensile elongation at break (%) | | 131.3 | 132.0 | — |
| | Strength at break (N) | | 783.25 | 875.4 | — |
| Preparation Example 1-3 | Tensile elongation under different loads (%) | 34.7 (340N) | 53.1 | 61.4 | 8.3 |
| | | 51 (500N) | 67.6 | 89.1 | 21.5 |
| | | 75 (735N) | 111.5 | — | — |
| | Tensile elongation at break (%) | | 132.7 | 114.7 | — |
| | Strength at break (N) | | 799 | 572.3 | — |
| Preparation Example 1-4 | Tensile elongation under different loads (%) | 34.7 (340N) | 35.0 | 22.0 | 13.0 |
| | | 51 (500N) | 57.0 | 33.0 | 24.0 |
| | | 75 (735N) | 87.0 | 54.0 | 33.0 |
| | Tensile elongation at break (%) | | 182.0 | 182.0 | — |
| | Strength at break (N) | | 1,100 | 2,000 | — |
| Preparation Example 1-5 | Tensile elongation under different loads (%) | 34.7 (340N) | 30.0 | 32.0 | 2.0 |
| | | 51 (500N) | 55.0 | 56.0 | 1.0 |
| | | 75 (735N) | 95.0 | 96.0 | 1.0 |
| | Tensile elongation at break (%) | | 314.0 | 174.0 | — |
| | Strength at break (N) | | 1,630 | 978 | — |
| Preparation Example 1-6 | Tensile elongation under different loads (%) | 34.7 (340N) | 17.0 | 22.0 | 5.0 |
| | | 51 (500N) | 31.0 | 42.0 | 11.0 |
| | | 75 (735N) | 55.0 | 75.0 | 20.0 |
| | Tensile elongation at break (%) | | 257.0 | 157.0 | — |
| | Strength at break (N) | | 1,760 | 1,100 | — |

Referring to Tables 1 and 2, in Preparation Example 1-5 designed to have a sum of strengths of the elastic monofilament grey yarn, used within 1 inch of each of the warp and weft directions, of 5.0% or less based on one of the warp and weft directions, the difference in tensile elongation between the warp and weft directions under a constant load was at most 5.0%. Also, it was possible to prepare an elastic fabric satisfying the tensile elongation in a range of 20 to 50% under the load of 34.7 kgf, and the tensile elongation in a range of 50 to 90% under the load of 51 kgf.

Preparation Examples 1-5A to 1-5E: Preparation of Elastic Fabric 2

After conducting a scouring process on the elastic fabric of Preparation Example 1-5 (weft: 51/inch and warp: 49/inch) shown in Table 1 under scouring conditions to obtain different natural shrinkage rates, the elastic fabric was tested in accordance with the tensile elongation test (MS 300-32) under constant loads and the results are shown in Table 3 below.

TABLE 3

| Example | Scouring conditions: Temp. (° C.) | Scouring conditions: Speed (m/min) | — | Load (kgf) | Lengthwise (warp) | Transverse (weft) | Warp/weft difference |
|---|---|---|---|---|---|---|---|
| Preparation Example 1-5A | 70 | 25 | Tensile elongation under different loads (%) | 34.7 (340N) | 40 | 41 | 1 |
| | | | | 51 (500N) | 64 | 67 | 3 |
| | | | | 75 (735N) | 109 | 111 | 2 |
| | | | Natural shrinkage rate (%) | | 8 | 17 | — |
| Preparation Example 1-5B | 80 | 25 | Tensile elongation under different loads (%) | 34.7 (340N) | 34 | 35 | 1 |
| | | | | 51 (500N) | 63 | 60 | 3 |
| | | | | 75 (735N) | 105 | 103 | 2 |
| | | | Natural shrinkage rate (%) | | 10 | 20 | — |
| Preparation Example 1-5C | 95 | 25 | Tensile elongation under different loads (%) | 34.7 (340N) | 30 | 32 | 2 |
| | | | | 51 (500N) | 55 | 56 | 1 |
| | | | | 75 (735N) | 95 | 96 | 1 |
| | | | Natural shrinkage rate (%) | | 14 | 23 | — |
| Preparation Example 1-5D | 95 | 10 | Tensile elongation under different loads (%) | 34.7 (340N) | 15 | 17 | 2 |
| | | | | 51 (500N) | 42 | 45 | 3 |
| | | | | 75 (735N) | 70 | 77 | 7 |
| | | | Natural shrinkage rate (%) | | 32 | 40 | — |

TABLE 3-continued

| Example | Scouring conditions Temp. (° C.) | Speed (m/min) | — | Load (kgf) | Lengthwise (warp) | Transverse (weft) | Warp/weft difference |
|---|---|---|---|---|---|---|---|
| Preparation Example 1-5E | 95 | 15 | Tensile elongation under different loads (%) | 34.7 (340N) | 22 | 25 | 3 |
| | | | | 51 (500N) | 52 | 49 | 3 |
| | | | | 75 (735N) | 75 | 80 | 5 |
| | | | Natural shrinkage rate (%) | | 28 | 35 | — |

Referring to Table 3, although the samples of Preparation Examples 1-5A and 1-5B scoured at a temperature below 90° C. had a natural shrinkage rate of 30% or less, the tensile elongation under the load of 75 kgf exceeded 100%. When the tensile elongation exceeds 100%, resilience is lost due excessive stretching of the fabric.

In addition, in the case of the samples of Preparation Examples 1-5D and 1-5E scoured at a speed less than 20 m/min, the natural shrinkage rate exceeded 30% in the warp and/or weft directions. In this case, an elastic fabric satisfying the difference in tensile elongation of 5.0% or less between the warp and weft directions under a constant load, the tensile elongation in a range of 20 to 50% under the load of 34.7 kgf, and the tensile elongation in a range of 50 to 90% under the load of 51 kgf could not be prepared.

Preparation Examples 2-1 to 2-12: Preparation of Elastic Fabric 3

The elastic fabric, as a fabric applied to seat cushions, should have satisfactory flame retardancy. Therefore, after applying flame retardancy to the elastic fabric by using various methods for satisfactory flame retardancy, flame retardancy thereof was measured and the results are shown in Table 4 below.

In Table 4 below, the elastic fabrics of Preparation Examples 2-1 to 2-10 were woven from elastic monofilament grey yarn formed of a resin not containing a flame retardant and then treated with a flame retardant, and the elastic fabrics of Preparation Examples 2-11 and 2-12 were woven from elastic monofilament grey yarn formed of a flame retardant resin including a phosphorus-based flame retardant.

Evaluation of the flame retardancy was performed by a flame retardancy test (MS 300-08) using different types of the flame retardant, treatment methods, and conditions. The flame retardancy test was performed by measuring burning velocity (mm/min) of samples having a width of 100 mm and a length of 350 mm, and criteria of flame retardancy evaluation are as follows.

Flame Retardancy Evaluation Criteria

Burning velocity over 80 mm/min: bad

Burning velocity of 80 mm/min or less: good

Self-extinguishability (S.E): superior

TABLE 4

| Example | Conditions for Flame Retardancy Treatment: Treatment method | Flame retardant | Concentration (%) | Temp. (° C.) | Burning velocity (mm/min): Weft direction | Warp direction |
|---|---|---|---|---|---|---|
| Preparation Example 2-1 | Copper bath dyeing | bromine-based | 10 | 120 | 86 | S.E |
| Preparation Example 2-2 | | | 15 | | 98 | S.E |
| Preparation Example 2-3 | | phosphorus-based | 5 | | 199 | S.E |
| Preparation Example 2-4 | | | 7 | | 150 | S.E |
| Preparation Example 2-5 | | | 15 | | 199 | S.E |
| Preparation Example 2-6 | | | 20 | | 176 | S.E |
| Preparation Example 2-7 | | | 15 | 130 | 176 | S.E |
| Preparation Example 2-8 | | | 20 | | 166 | S.E |
| Preparation Example 2-9 | Flame retardant treatment for padding (mangle machine) | phosphorus-based | — | — | 148 | 70 |
| Preparation Example 2-10 | Back coating (direct coating) | phosphorus-based | — | — | flame retardant and binder detached (not adhered) | |
| Preparation Example 2-11 | 0.4 mm elastic hot-melt flame retardant yarn | phosphorus-based | 15 | — | 83 | S.E |
| Preparation Example 2-12 | | | 20 | — | S.E | S.E |

Referring to Table 4, to satisfy self-extinguishability, which is flame retardancy of automobiles, it was confirmed that the elastic fabric should be prepared after applying a phosphorus-based flame retardant to the elastic monofilament grey yarn.

Preparation Examples 3-1 to 3-9: Preparation of Elastic Fabric 4

As shown in Table 5 below, elastic fabrics were prepared by adjusting the amount of the soft segment in the polyester elastomer, as a component of the fiber, and adjusting the thickness of the elastic grey yarn. Warp density and weft density of each elastic fabric were fixed to the above-described 51 wefts/inch and 49 warps/inch, which satisfied the tensile elongation conditions of the present disclosure among Preparation Examples 1 to 5. In addition, as the grey yarn, the sheath/core-type hot-melt elastic monofilament was used, and the elastic fabric was subjected to the scouring process and heat treatment as shown in Table 5 below.

TABLE 5

| | Processing conditions of elastic fabric | | | | |
|---|---|---|---|---|---|
| Example | Hard segment (wt. %) | Soft segment (wt. %) | Thickness of grey yarn (mm) | Scouring temperature (° C.) | Heat treatment temperature (° C.) |
| Preparation Example 3-1 | 85 | 15 | 0.15 | 91 | 150 |
| Preparation Example 3-2 | 52 | 48 | 0.15 | 92 | 160 |

TABLE 5-continued

| | Processing conditions of elastic fabric | | | | |
|---|---|---|---|---|---|
| Example | Hard segment (wt. %) | Soft segment (wt. %) | Thickness of grey yarn (mm) | Scouring temperature (° C.) | Heat treatment temperature (° C.) |
| Preparation Example 3-3 | 85 | 15 | 0.46 | 92 | 163 |
| Preparation Example 3-4 | 52 | 48 | 0.47 | 94 | 158 |
| Preparation Example 3-5 | 85 | 15 | 0.60 | 91 | 150 |
| Preparation Example 3-6 | 85 | 15 | 0.15 | 85 | 150 |
| Preparation Example 3-7 | 85 | 15 | 0.15 | 97 | 150 |
| Preparation Example 3-8 | 85 | 15 | 0.15 | 91 | 146 |
| Preparation Example 3-9 | 85 | 15 | 0.15 | 91 | 170 |

Tensile elongation of the elastic fabrics prepared under the conditions shown in Table 5 was measured in the warp and weft directions respectively under the loads of 20 kgf and 40 kgf, and a difference in the tensile elongation values was calculated and shown in Table 6 below.

Specifically, the tensile elongation of the elastic fabric under a constant load was measured by measuring a displacement (%) of the elastic fabric sample having a width of 50 mm and a length of 250 mm under the constant load, respectively, under the loads of 20 kgf and 40 kgf, using a tensile tester for fibers at a distance between gauge marks of 100 mm at a tensile speed of 200 mm/min.

TABLE 6

| | Tensile elongation under load of 20 kgf (%) | | | Tensile elongation under load of 40 kgf (%) | | |
|---|---|---|---|---|---|---|
| Example | Transverse direction (warp) | Lengthwise direction (weft) | Transverse/lengthwise difference | Transverse direction (warp) | Lengthwise direction (weft) | Transverse/lengthwise difference |
| Preparation Example 3-1 | 32.8 | 32.7 | 0.1 | 70.8 | 70.5 | 0.3 |
| Preparation Example 3-2 | 35.2 | 35.4 | 0.2 | 87.6 | 87.8 | 0.2 |
| Preparation Example 3-3 | 23 | 22.7 | 0.3 | 63.8 | 63.5 | 0.3 |
| Preparation Example 3-4 | 28.2 | 28.1 | 0.1 | 64.1 | 64.3 | 0.2 |
| Preparation Example 3-5 | 18.2 | 18.4 | 0.2 | 38.9 | 39 | 0.1 |
| Preparation Example 3-6 | 33.5 | 25.4 | 8.1 | 70.5 | 59.8 | 10.7 |
| Preparation Example 3-7 | 34.1 | 42.5 | 8.4 | 71.2 | 79.8 | 8.6 |
| Preparation Example 3-8 | 15 | 15.2 | 0.2 | Sample break (not measurable) | | |
| Preparation Example 3-9 | 15.5 | 15.8 | 0.3 | Sample break (not measurable) | | |

Referring to Table 5, in the case of Preparation Examples 3-1 to 3-4, it was confirmed that the difference in tensile elongation between the warp and weft directions under a constant load was 5.0% or less, the tensile elongation was in a range of 20 to 50% under the load of 20 kgf, and the tensile elongation was in a range of 50 to 90% under the load of 40 kgf.

Examples 1 to 4 and Comparative Examples 1 to 11: Preparation of Seat Molded Article Seat molded articles according to Examples 1 to 4 and Comparative Examples 1 to 11 were prepared using different structures of the seat molded article, different types of the elastic fabric, and different thicknesses of polyurethane foam as shown in Table 7 below.

Specifically, in Example 1 to 4 and Comparative Example 2 to 7 (G-01), seat molded articles were prepared by locating the elastic fabrics respectively prepared in Preparation Examples 3-1 to 3-9 under the polyurethane foam. In Comparative Example 1 (G-02), a seat molded article was prepared by locating the elastic fabric of Preparation Example 3-1 on the polyurethane foam. In Comparative Example 8 (G-03), only the elastic fabric of Preparation Example 3-1 was used without using polyurethane foam. In Comparative Examples 9 to 11 (G-04), seat molded articles were prepared by locating suspension springs, which are commonly used in conventional seat cushions, instead of the elastic fabric under polyurethane foam.

In addition, the samples of Examples 1 to 4 and Comparative Examples 1 to 11 were mounted on a jig and the amount of sagging C under the load of 55 kgf and the amount of sagging D under the load of 100 kgf thereof were measured. Based on the amount of sagging measured under the load of 100 kgf, a ratio of the amount of sagging measured under the load of 55 kgf was calculated and shown in Table 7 below.

Specifically, the amount of sagging (mm) under a constant load was measured using a measurement plate having a width of 300 mm and a length of 250 mm by respectively applying the constant loads of 55 kgf and 100 kgf to the center of the plate.

TABLE 7

| Example | Type of elastic fabric | Thickness of urethane foam (mm) | Structure of seat molded article | Amount of sagging (mm) Load of 55 kgf (C) | Load of 100 kgf (D) | (C/D)*100 (%) |
|---|---|---|---|---|---|---|
| Example 1 | Preparation Example 3-1 | 25 | G-01 | 36 | 69 | 52.2 |
| Example 2 | Preparation Example 3-2 | 25 | G-01 | 38 | 72 | 52.8 |
| Example 3 | Preparation Example 3-3 | 25 | G-01 | 30 | 67 | 44.8 |
| Example 4 | Preparation Example 3-4 | 25 | G-01 | 28 | 65 | 43.1 |
| Comparative Example 1 | Preparation Example 3-1 | 25 | G-02 | 12 | 40 | 30.0 |
| Comparative Example 2 | Preparation Example 3-5 | 25 | G-01 | 23 | 46 | 50.0 |
| Comparative Example 3 | Preparation Example 3-6 | 25 | G-01 | 28 | 38 | 73.7 |
| Comparative Example 4 | Preparation Example 3-7 | 25 | G-01 | 30 | 80 | 37.5 |
| Comparative Example 5 | Preparation Example 3-8 | 25 | G-01 | 21 | 38 | 55.3 |
| Comparative Example 6 | Preparation Example 3-9 | 25 | G-01 | 23 | 36 | 63.9 |
| Comparative Example 7 | Preparation Example 3-1 | 20 | G-01 | 18 | 32 | 56.3 |
| Comparative Example 8 | Preparation Example 3-1 | 0 | G-03 | 10 | 20 | 50.0 |
| Comparative Example 9 | suspension springs | 70 | G-04 | 40 | 80 | 50.0 |
| Comparative Example 10 | suspension springs | 45 | G-04 | 35 | 48 | 72.9 |
| Comparative Example 11 | suspension springs | 25 | G-04 | 32 | 41 | 78.0 |

Structure of Seat Molded Article
G-01: upper urethane foam-lower elastic fabric
G-02: upper elastic fabric-lower urethane foam
G-03: elastic fabric without urethane foam
G-04: upper urethane foam-lower suspension springs Referring to Tables 5 to 7, in the case of Examples 1 to 4 in which the seat molded articles were prepared by disposing the elastic fabric under the polyurethane foam, wherein the elastic fabric satisfies the difference in tensile elongation of 5.0% or less between the warp and weft directions, the tensile elongation in a range of 20 to 40% under the load of 20 kgf, and the tensile elongation in a range of 40 to 90% under the load of 40 kgf, the amount of sagging measured under the load of 55 kgf was in the range of 25 to 50 mm, and the amount of sagging measured under the load of 55 kgf accounts for 40 to 70% of the amount of sagging measured under the load of 10 kgf. These physical properties provide a user with comfortable feelings when the user is sitting on the seat.

On the contrary, in the case of Comparative Example 1 in which the elastic fabric is disposed on the polyurethane foam, the amount of sagging measured under the load of 55 kgf was less than 25 mm, and the ratio of the amount of sagging measured under the load of 55 kgf to the amount of sagging measured under the load of 100 kgf was less than 40%.

In the case where the elastic fabric failed to satisfy the tensile elongation conditions according to the present disclosure (Comparative Examples 2 to 6) or in the case where the thickness of the polyurethane foam was less than 25 mm (Comparative Example 7), the amount of sagging (mm) under the load of 55 kgf or the ratio of the amount of sagging ratio under the load of 55 kgf based on the amount of sagging measured under the load of 100 kgf were not satisfied.

In addition, in the case of Comparative Example 8 in which only the elastic fabric was used without the polyurethane foam, the amount of sagging was less than 25 mm. In the case of using suspension springs instead of the elastic fabric (Comparative Examples 9 to 11), the amount of sagging conditions under a constant load are satisfied only when the polyurethane foam is thick enough to have a thickness of about 70 mm, and thus the volume of the seat molded article could not be reduced. In the case of using polyurethane foam having a thickness of 50 mm or less for volume reduction of the seat molded article, the ratio (%) of the amount of sagging under the load of 55 kgf to the amount of sagging measured under the load of 100 kgf could not be satisfied.

Furthermore, according to the seat molded article of the present disclosure, a large interior space may be obtained by manufacturing slim interior parts, fuel efficiency may be increased by reducing weight of vehicles, and eco-friendly properties such as reduction in $CO_2$ emission may also be expected.

A seat molded article according to the present disclosure may have a reduced thickness of polyurethane foam by using an elastic fabric instead of suspension springs and may provide excellent comfort performance although the thickness is smaller than products for seat cushions of vehicles. Specifically, because an amount of sagging under a load of 55 kgf is in the range of 25 to 50 mm, the seat molded article according to the present disclosure may provide 40 to 70% of the amount of sagging compared to the amount of sagging under a load of 100 kgf. This range provides optical conditions of seats for soft, comfortable feelings without causing feelings of irritation by the floor when a passenger is seated on a seat of a vehicle. Therefore, comfort requirements of seats of vehicles may be maintained while reducing thickness of parts thereof.

However, the effects obtainable by the present disclosure are not limited to the aforementioned effects, and any other effects not mentioned herein are understood from the following description by those skilled in the art to which the present disclosure pertains.

While the present disclosure has been particularly shown and described with reference to exemplary embodiments thereof, it will be understood by one of ordinary skill in the art that various changes in form and details may be made therein without departing from the spirit and scope of the present disclosure as defined by the following claims.

What is claimed is:

1. A seat molded article comprising:

an upper pad comprising polyurethane foam having a thickness in a range of 25 to 50 mm; and an elastic fabric disposed under the upper pad, wherein the elastic fabric comprises elastic monofilaments having a thermoplastic polyester elastomer resin as yarn, wherein the thermoplastic polyester elastomer resin comprises a hard segment and a soft segment, wherein the soft segment of the thermoplastic polyester elastomer resin comprises 10-50 wt. % of a total weight of the thermoplastic polyester elastomer resin, wherein, in the elastic fabric, a difference in a tensile elongation between a warp direction and a weft direction is 5.0% or less, and wherein the tensile elongation, measured under a load of 20 kgf, is in a range of 20 to 40% in the warp direction and the weft direction.

2. The seat molded article of claim 1, wherein the seat molded article has an amount of sagging, measured under a load of 55 kgf, in a range of 25 to 50 mm.

3. The seat molded article of claim 2, wherein the amount of sagging of the seat molded article, measured under the load of 55 kgf, accounts for 40 to 70% of the amount of sagging of the seat molded article measured under a load of 100 kgf.

4. The seat molded article of claim 1, wherein the tensile elongation of the elastic fabric, measured under a load of 40 kgf, is in a range of 40 to 90% in the warp direction and the weft direction.

5. The seat molded article of claim 1, wherein the tensile elongation of the elastic fabric, measured under a load of 34.7 kgf, is in a range of 20 to 50% in the warp direction and the weft direction, and wherein the tensile elongation of the elastic fabric, measured under a load of 51 kgf, is in a range of 50 to 90% in the warp direction and the weft direction.

6. The seat molded article of claim 1, wherein a thickness of the yarn is in a range of 0.14 to 0.5 mm.

7. The seat molded article of claim 1, wherein the yarn further comprises a flame retardant having phosphorus.

8. The seat molded article of claim 1, wherein the polyurethane foam comprises a polymer having 100 parts by weight of a polyol mixture A and 10 to 50 parts by weight of an isocyanate compound B.

9. The seat molded article of claim 8, wherein the polyol mixture A comprises a polyether polyol having 2 to 6 hydroxyl groups, and wherein the isocyanate compound B comprises: a polymer of an isocyanate mixture of monomeric methylene diphenyl diisocyanate and polymeric methylene diphenyl diisocyanate with a polyether polyol; or toluene diisocyanate.

10. A method of preparing a seat molded article, the method comprising:

preparing a polyurethane foam having a thickness in a range of 25 to 50 mm;

preparing an elastic fabric; and disposing the elastic fabric under the polyurethane foam, wherein the preparing of the elastic fabric comprises:

weaving the elastic fabric from yarn comprising a thermoplastic polyester elastomer resin in which a hard segment and a soft segment are polymerized;

scouring the elastic fabric at a temperature in a range of 90 to 95° C.; and heat-treating the scoured elastic fabric at a temperature in a range of 150 to 165° C.

11. The method of claim 10, wherein the soft segment is included in an amount in a range of 10 to 50 wt. % based on a total weight of the thermoplastic polyester elastomer resin.

12. The method of claim 10, wherein a thickness of the yarn is in a range of 0.14 to 0.5 mm.

13. The method of claim 10, wherein the scouring of the elastic fabric is performed at a scouring rate in a range of 20 to 25 m/min.

14. The method of claim 10, wherein a natural shrinkage rate of the scoured elastic fabric is 30% or less.

15. The method of claim 10, wherein the preparing of the polyurethane foam comprises:

preparing a polyol mixture A by mixing a polyether polyol having 2 to 6 hydroxyl groups, a foam stabilizer, and a catalyst;

performing condensation polymerization of 10 to 50 parts by weight of an isocyanate compound B with 100 parts by weight of the polyol mixture A to provide a polymer; and foaming the polymer.

16. The method of claim 15, wherein the isocyanate compound B comprises:

a polymer of an isocyanate mixture including a monomeric methylene diphenyl diisocyanate and a polymeric methylene diphenyl diisocyanate with a polyether polyol; or a toluene diisocyanate.

* * * * *